US008777280B2

(12) United States Patent
Bastianini

(10) Patent No.: US 8,777,280 B2
(45) Date of Patent: Jul. 15, 2014

(54) ELECTRICALLY CONTROLLED LOCK FOR AUTOMATED SLIDING TYPE GATES AND CONTROL METHOD FOR THE SAME

(75) Inventor: Filippo Bastianini, Bologna (IT)

(73) Assignee: Viro S.p.A. (IT)

( * ) Notice: Subject to any disclaimer, the term of this patent is extended or adjusted under 35 U.S.C. 154(b) by 0 days.

(21) Appl. No.: 13/823,632

(22) PCT Filed: Oct. 21, 2011

(86) PCT No.: PCT/IT2011/000355
§ 371 (c)(1),
(2), (4) Date: Mar. 14, 2013

(87) PCT Pub. No.: WO2012/059947
PCT Pub. Date: May 10, 2012

(65) Prior Publication Data

US 2013/0181462 A1 Jul. 18, 2013

(30) Foreign Application Priority Data

Nov. 3, 2010 (IT) ..... BO2010A0657

(51) Int. Cl.
*E05C 3/06* (2006.01)

(52) U.S. Cl.
USPC ..... 292/201; 292/DIG. 29

(58) Field of Classification Search
USPC ..... 292/201, DIG. 29, 144
See application file for complete search history.

(56) References Cited

U.S. PATENT DOCUMENTS 2,901,053 A 8/1959 Lassiter
4,072,032 A * 2/1978 Phillips ..... 70/339
4,136,540 A * 1/1979 Coralli et al. ..... 70/100
4,159,138 A 6/1979 Smith
4,565,079 A * 1/1986 Smith ..... 70/134
4,796,385 A 1/1989 Tyler
5,588,314 A * 12/1996 Knezovich ..... 70/56
6,032,987 A 3/2000 Fukumoto
6,192,723 B1 * 2/2001 Brownell, Sr. ..... 70/97

(Continued)

FOREIGN PATENT DOCUMENTS

DE 1553597 12/1969
DE 19911780 10/2000

(Continued)

OTHER PUBLICATIONS

International Search Report and Written Opinion dated Mar. 20, 2012 from counterpart PCT application.

*Primary Examiner* — Mark Williams
(74) *Attorney, Agent, or Firm* — Timothy J. Klima; Shuttleworth & Ingersoll, PLC

(57) ABSTRACT

A lock device for sliding gates has a harpoon-type bolt element whose head enters a cavity of a keeper from a shaped hole, and is pushed inside a sleeve by a roto-translation that is controlled by a cam and tappet coupling until the system is locked Reverse motion is prevented by engagement between the anchor of a solenoid and an elongated cavity on the surface of the bolt shaft, however allowing the bolt to tolerate axial displacements from thermal changes or settlements. An unlock control logic allows release of the engagement via a European profile lock cylinder, a mechanical control remotely operated through a Bowden wire, or an electrically controlled solenoid. The control logic ensures the system operation follows the correct direction of motion of a cyclic state machine, to provide proper synchronization with the operation of the gate automation.

20 Claims, 4 Drawing Sheets

(56) References Cited

U.S. PATENT DOCUMENTS

| | | | | |
|---|---|---|---|---|
| 6,295,849 | B1 * | 10/2001 | Gartner et al. | 70/277 |
| 2005/0236847 | A1 | 10/2005 | Taniyama | |
| 2006/0213239 | A1 | 9/2006 | Roatis et al. | |
| 2009/0267361 | A1 | 10/2009 | Alber | |

FOREIGN PATENT DOCUMENTS

| | | |
|---|---|---|
| DE | 102004018759 | 11/2005 |
| DE | 102008021081 | 12/2009 |
| EP | 0035979 | 9/1981 |
| EP | 0606938 | 7/1994 |
| EP | 0789126 | 8/1997 |
| EP | 1335085 | 11/2002 |
| FR | 2843156 | 2/2004 |
| GB | 868366 | 5/1961 |
| GB | 1111513 | 5/1968 |
| GB | 2132260 | 7/1984 |
| GB | 2197381 | 5/1988 |
| GB | 2457990 | 9/2009 |
| IT | 20030670 | 5/2005 |
| IT | 20050505 | 1/2007 |
| IT | 20060617 | 2/2008 |
| JP | 61021282 | 1/1986 |
| JP | 2009174174 | 8/2009 |
| JP | 2010121437 | 6/2010 |
| KR | 100773299 | 11/2007 |
| KR | 200440787 | 6/2008 |
| KR | 200443554 | 2/2009 |
| KR | 100891104 | 3/2009 |
| KR | 20090081802 | 7/2009 |
| KR | 20090009277 | 9/2009 |

* cited by examiner

ELECTRICALLY CONTROLLED LOCK FOR AUTOMATED SLIDING TYPE GATES AND CONTROL METHOD FOR THE SAME

TECHNICAL FIELD OF THE INVENTION

This application is the National Phase of International Application PCT/IT2011/000355 filed Oct. 21, 2011 which designated the U.S. and that International Application was published under PCT Article 21(2) in English.

This application claims priority to Italian Patent Application No. B02010A000657 filed Nov. 3, 2010 and PCT Application No. PCT/IT2011/000355 filed Oct. 22, 2011, which applications are incorporated by reference herein.

The present invention relates to a rotating harpoon bolt type lock device for sliding-type gates and to a control method for the same device that is intended to ensure its proper operation when the device is installed on an automatically-operated gate.

PREVIOUS STATE OF THE ART

Several different types of lock devices for sliding-type doors are known. Patents DE 102008027081A1 (Dziurdzia; Koenkler), GB2457990A (Bradbury), JP2009174174A (Nakagawa; Takeda) and JP2010121437A (Hamawaki) disclose lock device mechanisms having at least one bolt that is moved along an axis normal to the direction of motion of the sliding door.

Patents GB2197381A (Wong Kwan-Yu), GB868366 (Goh Hiow), KR100773299B 1, KR 100891104B1 (Jang Kong Ik), KR200440287Y 1, KR200443554Y1, KR20090009277U, KR20090081802A (Kim Yong Bum) and US2009267361A1 (Alber) disclose lock device mechanisms having one or more hook-type bolts that rotates around an axis normal to the direction of motion of the sliding door.

Lock devices specifically intended for car doors and remotely operated by means of Bowden wire type controls are known, such as in the patents US2005236847A1 (Taniyama), DE1991 1780A 1 (Hoppensack) and U.S. Pat. No. 6,032, 987A (Fukumoto; Makiuchi).

Various lock devices where the lock disengagement can be operated electrically are also known, such as in the patents EP0035979 (Borgato), U.S. Pat. No. 6,192,723 (Brownell), FR2843156 (De Plinval), DE 102004018759A1 (Theis), ITBO2003A000670 (Errani) and ITBO2005A000505 (Bonori).

All the lock system listed in the above are characterized by a low tolerance of the position of the door in the locked state and can easily jam when the thermal dilatations of the door or the settlements of the frame induce transverse mechanical load on the bolt.

Patents U.S. Pat. No. 4,159,138 (Smith), GB 1 1 1 1513 (Jeavons), EP1335085A1 (Talpe) and DE 1553597A 1 (Schaudel) disclose lock devices comprising an harpoon-type snap-acting bolt that engages a keeper assembly by rotating around an axis that is parallel to the direction of motion of the sliding door.

The abovementioned devices are not electrically controlled, and do not have any specific feature intended to enlarge the mechanical tolerance for the position of the door in the locked state, and in particular considering the large thermal dilatation that characterizes larger sliding gates.

It is known the patent ITBO2006A000617 (Bastianini) disclosing an electrically controlled harpoon-type snap-acting lock device capable to accept a large mechanical tolerance for the position of the door in the locked state, but can not be used on automatically-operated sliding gates due to the fact that it does not ensure a proper synchronization between the lock disengagement and the movement of the automated gate.

What is clear from the analysis of the abovementioned state of the art is that:

a) known lock devices, when applied to large sliding gates, generally do not allow a mechanical tolerance for the position of the gate in the locked state that could large enough to ensure that no lock jamming can be produced especially by thermal distortions; and b) known lock devices, when applied to large sliding gates, generally do not comprise any specific protection device against burglary attempts carried out by trying to cut or saw the bolt element; and c) known electrically controlled lock devices do not comprise any specific burglary protection intended to prevent the removal of the cover when the device is in locked state; and d) known electrically controlled lock that can be applied to sliding gates do not comprise any remotely operated manual disengagement control: and e) known electrically controlled lock that can be applied to automated sliding gates do not comprise any system intended to provide a simple and effective synchronization between the disengagement control and the operation of the automated gate.

DISCLOSURE OF THE INVENTION

In a first broad independent aspect, the present invention provides a lock device comprising an harpoon-type snap-acting bolt that is capable to engage or disengage a keeper assembly through a rotation of the bolt around its own axis that is parallel to the direction of motion of the sliding gate, and the same lock device is capable to accept a wide mechanical tolerance for the position of the gate in the locked state by freely allowing the translation stroke of the bolt in the direction of motion of the sliding gate. In a first subsidiary aspect, the present invention combines the lock device with a control system and possibly with a control method intended to synchronize the electrical disengagement of the lock with the normal operation of the automated gate.

In a second subsidiary aspect, the present invention combines the lock device with a Bowden wire mechanical remote control system intended to provide the possibility to manually operate the disengagement of the lock when needed.

In a third subsidiary aspect, the present invention combines the lock device with a burglary protection system intended to prevent the possibility of sawing the bolt shaft by means of at least one bush that is installed on the part of the shaft that remains accessible between the lock encasing and the keeper and is left free to rotate on the said shaft.

In a fourth subsidiary aspect, the present invention combines the lock device with a burglary protection system intended to prevent the possibility of opening the lock encasing when the device is in the locked state by means of a fork-shaped device that moves along with the bolt and that engages a hook on the cover of the encasing when the bolt is brought in the locked position.

BRIEF DESCRIPTION OF THE DRAWINGS

A full and enabling disclosure of the present invention, including the best mode thereof, directed to one of ordinary skill in the art, is set forth in the specifications, which makes reference to the appended figures, in which.

DETAILED DESCRIPTION OF THE PREFERRED EMBODIMENTS

Selected combinations of aspects of the disclosed technology correspond to a plurality of different embodiments of the present invention. It should be noted that each of the exemplary embodiments presented and discussed herein should not insinuate limitations of the present subject matter. Features or steps described as part of one embodiment may be used in combination with aspects of another embodiment to yield yet further embodiments. Additionally, certain features may be interchanged with similar devices of features not expressly mentioned which perform the same or similar function.

Figure 1:
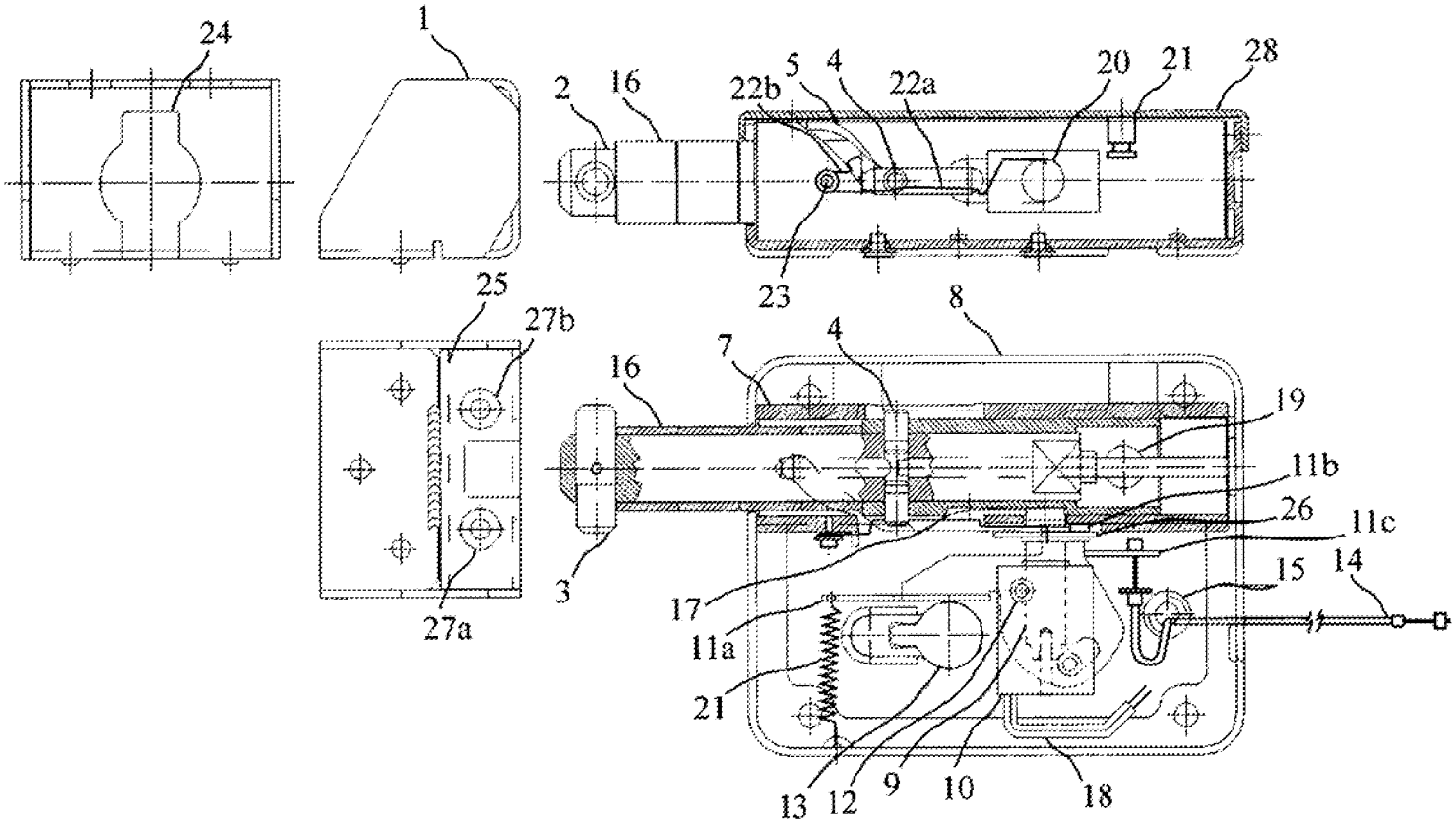
FIG. 1 illustrates a preferred embodiment of the device object of the present invention by means of a schematic section sketch from different points of view.

In FIG. 1 is presented a preferred embodiment of the device object of the present invention.

The device comprises one piston (2) that is protruding in the gap between the sliding gate and its frame, and is characterized by at least one laterally protruding tooth (3) close to its free edge the will be named head of the harpoon in the description that follows.

When the gate is closing, the head of the harpoon engages an hollow keeper (1) by entering through a properly shaped hole (24) that faces the harpoon, then reaches the bottom wall of the keeper (25) and is pushed back inside a sleeve (7) that is fixed to the chassis of the lock (8). Consequently to the coupling between at least one tappet (4) fixed to the piston (2) and one desmodromic cam (5) that is milled in the material of the sleeve (7), the backward translation of the piston (2) is linked to a rotation of the same that, moving backward, drives the teeth (3) to engage the harpoon inside the chamber of the keeper (1) so that to prevent the possibility of disengagement consequently to a pure axial translation.

Continuing the backward translation, the system reaches a locking position at which the head of the anchor (9) of a solenoid (10), under the action a spring, founds the first alignment point with a cavity (17) on the lateral surface of the piston (2) and is pushed inside the cavity so that the possibility that the piston (2) could move backward is prevented.

Proper shape and dimensions of the cavity (17) and of the cam (5) allow the free translation of the piston (2) along its own axis, between the two border positions respectively of first and of last alignment point between the anchor (9) and the cavity (17), with the piston (2) remaining in the locked position that ensures the engagement between the harpoon and the keeper (1), but allowing the lock to tolerate relatively wide changes in the position of edge of the gate while remaining locked, so that settlements and thermal distortions cannot load the bolt and jam the lock by increasing the level of friction that can be tolerated by the control solenoid (10).

The lock device comprises different unlocking mechanisms that are intended to release the head of the anchor (9) from the cavity (17) in order to allow that the piston (2) could be extracted out from the sleeve (7) crossing back the first point of alignment between the anchor (9) and the cavity (17) and therefore also allowing the piston (2) to rotate in the opposite direction, disengage the head of the harpoon from the keeper chamber and allowing the gate to follow the opening movement.

The different unlocking mechanisms may comprise:

the activation of the solenoid (10) by forcing an electrical current through the solenoid coil;

the manually driven operation of a cylinder lock (13) whose pawl is capable to act on the arm (1 I a) of a leverage overcoming the action of a coil spring (21) thus producing a rotation of the leverage around the hinge point (12) and causing a different arm (1 Ib) of the same leverage to act on the shoulder (26) of the solenoid anchor (9) in order to obtain the disengagement of the said anchor (9) from the cavity (17); the operation of a Bowden wire type remote mechanical control (14) acting on a further different arm (11*c*) of the abovementioned leverage is a way similar to what has been described in the previous section.

The lock device comprises additional features intended to prevent burglary attempts, and in particular:

the hole (15) for the Bowden wire (14) and for the solenoid cables (18) is located in a protected position of the lock chassis, so that the cables are not easily accessible especially in the gap between the lock and the cable raceway;

at least one bush (16) is installed on the part of the shaft of the piston (2) that remains accessible between the lock encasing and the keeper and is left free to rotate on the said shaft;

the fixing holes of the keeper assembly (1) and the holes (27*a*, 27*b*) for allowing the tool to access the fixing elements are positioned so that the fixing elements are not accessible when the harpoon results engaged inside the keeper assembly chamber and is rotated in the locked position;

the cover (28) of the lock chassis has a hook-acting element (21) that is engaged by a retention fork element controlled by the position of the piston (2), in a way that prevent the cover to be removed when the piston (2) is in the locked position.

The lock device furthermore comprises at least one additional feature intended to provide interfacing with the gate automation system, and in particular allow the lock device to be electrically released by connecting it to one electrical signal that does not require a synchronization or timing logic different to the logic of the signals that are commonly available in an ordinary gate automation system.

The preferred embodiment of the said interfacing feature is a cyclic state machine having one specific fixed direction of motion along the states of the cycle. The cyclic state machine is described starting from an initial locked stable state where the lock is in one of the permitted locked position of the piston (2). When the sliding gate is going to be opened, at least one of the abovementioned unlocking mechanisms is operated, and the system changes its own state jumping into an intermediate metastable unlocked state during which the anchor (9) of the solenoid is kept outside the cavity (17) of the piston (2). Such intermediate metastable unlocked state is kept until, due to the progressive motion of the opening gate, the piston (2) is extracted from the sleeve (7) enough to surpass the first alignment point between the anchor (9) and the cavity (17), and after this first alignment point is surpassed, the system jumps to the final stable unlocked state where the lock is in one of the permitted unlocked position of the piston (2).

After the final stable unlocked state is reached, under the action of the sliding gate when it is being closed, the system can close the cycle of its allowed states jumping directly into the initial locked stable state, that is reaching the locked state without passing through the intermediate metastable unlocked state.

The preferred embodiments of the abovementioned cyclic state machine are mechanical systems and electronic systems, and all of them must at least be active when the lock is to be controlled electrically.

The abovementioned cyclic state machine can be obtained with an embodiment where the transition from the intermediate metastable unlocked state to the final stable unlocked state is controlled by a feedback on the position of the piston (2).

The abovementioned cyclic state machine can be obtained with an embodiment where the transition from the intermediate metastable unlocked state to the final stable unlocked state is controlled through a timed monostable system that forces the state transition after a suitable delay from the beginning of the unlock control, being the said delay long enough to ensure that the piston (2) has reached the final stable unlocked state due to the opening stroke of the gate.

Figure 2:
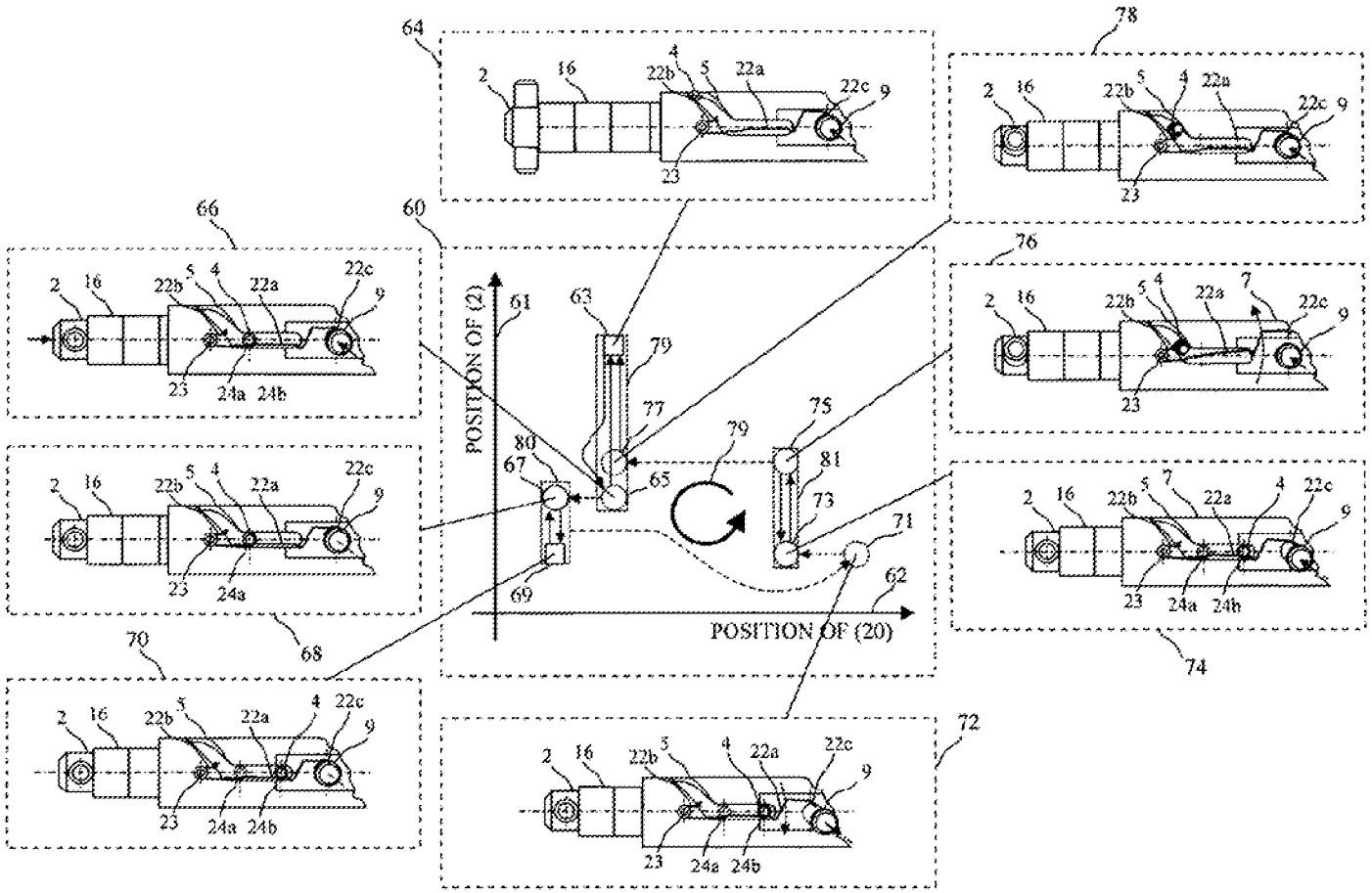
FIG. 2 illustrates the preferred embodiment of the present invention where is presented a detailed explanation of the mechanical state machine solution intended to ensure the synchronization of the disengagement of the lock with the operation of the gate.

In FIG. 2 is presented a preferred embodiment of the abovementioned cyclic state machine through a mechanical system. The state machine can scan the possible states of the cycle counterclockwise only (79) by following the transitions that are indicated by the arrows that connect the different states in the chart of the frame (60) where the horizontal coordinate (62) reflects the position of the anchor (9) and the vertical coordinate (61) reflects that of the piston (2). The frame (80) comprises all the allowed positions of the piston (2) that belong to the initial locked stable state, and the border points of the said locked stable state are the points (67) and (69), respectively the start and end points where the alignment between the solenoid anchor (9) and the cavity (17) is possible.

The frame (70) illustrates the mechanical configurations of the lock system in the condition identified by the point (69) on the chart; the piston (2) is at its maximum allowed insertion point inside the sleeve (7) and the tappet (4) is at the end alignment point (24*b*), close to the end of the straight section of the desmodromic cam (5), of the section where the said tappet (4) acts on the segment (22*a*) of a properly shaped elastic element whose free end (22*c*) is pushed against a shoulder on the lateral surface of the solenoid anchor (9), being the anchor (9) in a state of partial insertion in the cavity (17).

Starting from any of the allowed positions of the piston (2) that belong to the initial locked stable state (80), the pulsed action of any of the unlocking mechanisms instantly brings the system in the instable state (71). The frame (72) illustrates the mechanical configurations of the lock system in the condition identified by the point (71) on the chart, where the anchor (9) is moved inside the solenoid (10) far enough to be completely extracted from the cavity (17) and to allow the free end (22*c*) of the said elastic element to overcome the obstacle of the shoulder on the lateral surface of the anchor (9), so that it is pushed on the section of the lateral surface having a smaller diameter.

From the instable state (71), that is held only during the duration of the pulsed unlocking action, the state machine is then forced to jump into the starting point (73) of an interval of positions of the piston (2) that belong to the intermediate metastable unlocked state, that is identified by the frame (81) on the chart.

The frame (74) illustrates the mechanical configurations of the lock system in the condition identified by the point (73) on the chart, and it is shown how the free end (22*c*) of the elastic element remains trapped by the frictions between the sleeve (7) and the frontal ring surface of the shoulder on the anchor (9), thus preventing that the anchor (9) could fall again inside the cavity (17) under the action of the coil spring that pulls the anchor (9) of the solenoid (10).

Once the point (73) is reached, the piston (2) can travel to any of the points that belong to the intermediate metastable unlocked state (81) without the possibility that the anchor (9) could fall again inside the cavity (17), and this remains true until the point (75) is reached, due to the action of the gate motion when opening.

Once the point (75) is reached, the mechanical configurations of the lock system, that is shown in the frame (76) is characterized by a position of the tappet (4) that is outside the straight section of the cam (5) and where the tappet (4) releases its action on the section (22*a*) of the elastic element and at the same time gives a feedback on the position of the piston (2) by pushing on a different section (22*b*) of the elastic element so that to overcome the frictions that where trapping its free edge (22*c*) between the sleeve (7) and the shoulder of the anchor (9). As a result of the said feedback, the elastic element rotates around the hinge point (23) and releases the anchor (9) so that, under the action of a spring, is extracted from the solenoid (10) and pushed inside the sleeve (7) until it reaches the lateral surface of the piston (2) in an area where, considering the new position of the piston (2), there is no alignment between the anchor (9) and the cavity (17).

Consequently, once the point (75) is reached, the system is forced to jump from the end point (75) of the intermediate metastable unlocked state (81) to the point (77) of the interval of possible mechanical configurations that belong to the final stable unlocked state (79).

The frame (78) illustrates the mechanical configurations of the lock system in the condition identified by the point (77) on the chart, within the final stable unlocked state (79).

In the said configuration (78) the tappet (4) overcame the point where it can act on the arm (22*b*) of the elastic element and at the same time the anchor (9) has reached a new position where the free edge (22*c*) of the same elastic element stops against the shoulder on the lateral surface of the solenoid anchor (9).

Once the point (77) is reached, the piston (2) can travel to any of the points that belong to the final stable unlocked state (79) according to the law of roto-translation motion imposed by the coupling between the cam (5) and the tappet (4). The final stable unlocked state (79) is abandoned only when its border point (65) is reached, a condition that instantaneously brings the state machine in the start point (67) of the locked stable state.

Figure 3:
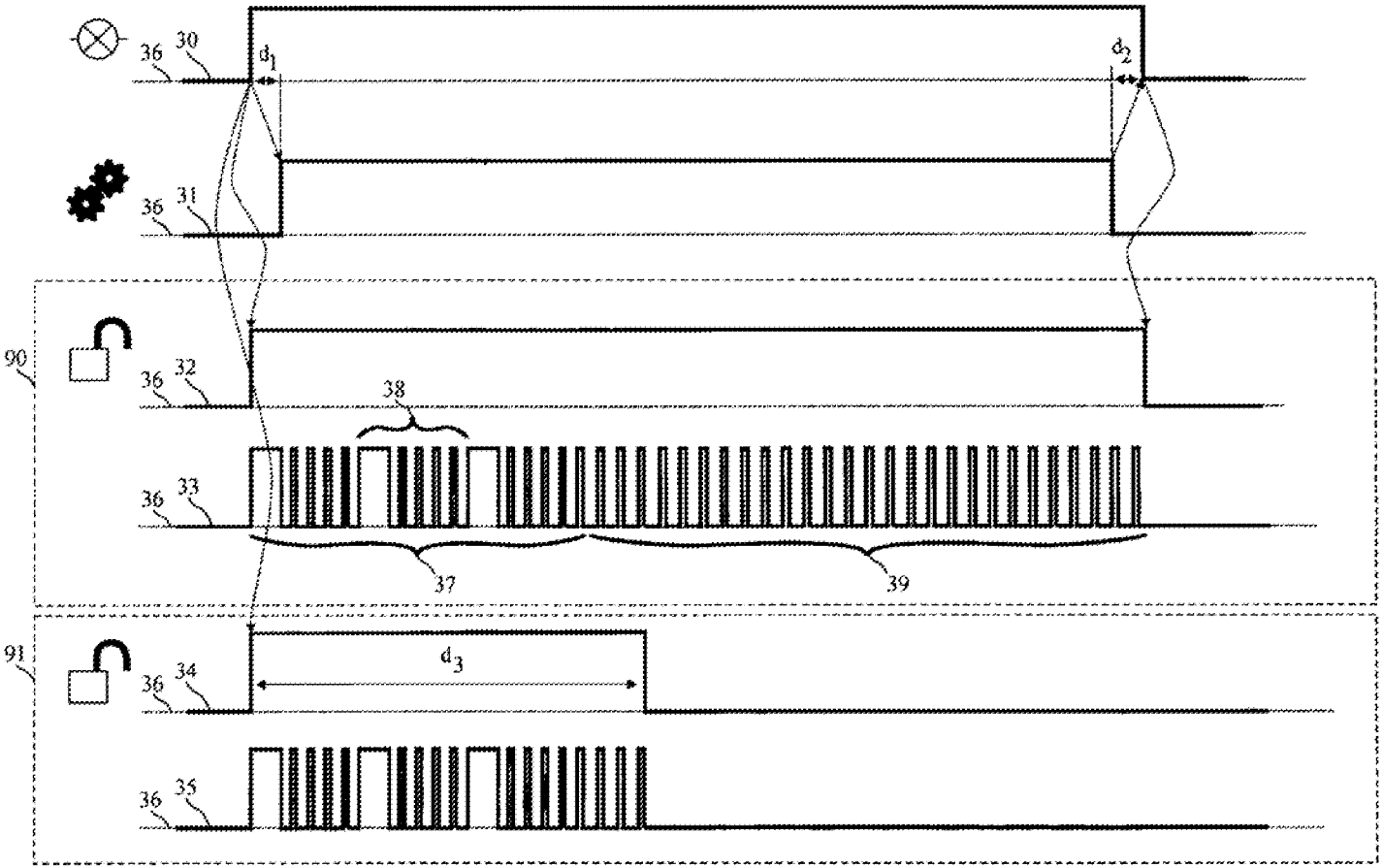
FIG. 3 illustrates the timing for the logic signals of some possible control methods that can be applied with an electronic control system to the preferred embodiment of the present invention, in order to ensure the synchronization of the disengagement of the lock with the operation of the gate.

FIG. 3 illustrates the timing for the logic signals of the preferred control method that can be applied to the present invention to obtain the function of the said cyclic state machine through an electronic system.

In FIG. 3 the logic state of some signals is illustrated in form of time history traces (30, 31, 32, 33, 34 and 35) according to chart conventions that have the time on the horizontal axis and where the active logic status is presented as a trace shift from the trace baseline (36).

Trace (31) illustrates the activity of the gate motion as controlled from the gate automation system.

Trace (30) illustrates the activity of the machinery-in-motion warning flasher that is normally installed on automated gates. The flasher is commonly activated few seconds in advance with respect to when the gate motion is actually started, and it is switched off few seconds after the motion has ended.

In the frame (90) is illustrated one possible feedback-driven logic that embodies the abovementioned state machine. Trace (32) reflects the state of activation of the solenoid (10) in order to keep the lock system in the intermediate metastable unlocked state, the solenoid (10) is activated when the flasher is switched on and is deactivated when the flasher is switched off. Trace (33) presents a variant of the same activation logic where, considering the changes in the magnetic circuit of the solenoid (10) during the motion of its own anchor (9), a pulse width modulation technique is used to reduce the electrical power consumption. However, at the beginning of the solenoid activation (37) the solenoid is energized with a pulse train that starts with a pulse of longer duration, so that to ensure the static friction is won by the maximum possible recall force of the anchor (9).

The beginning phase (37) is then followed by a subsistence phase (39) where the current consumption is limited through the pulse width modulation technique at the minimum level that keeps the magnetic circuit closed.

In the frame (91) is illustrated a different control logic that is based on a timed monostable. Trace (34) reflects the state of activation of the solenoid (10) in order to keep the lock system in the intermediate metastable unlocked state, the solenoid (10) is activated when the flasher is switched on and it is deactivated after a delay "d3" from the activation is elapsed. Trace (35) illustrates a variant of the same control logic where a pulse modulation technique is used with the same scope of the case illustrated in the frame (90).

Figure 4:
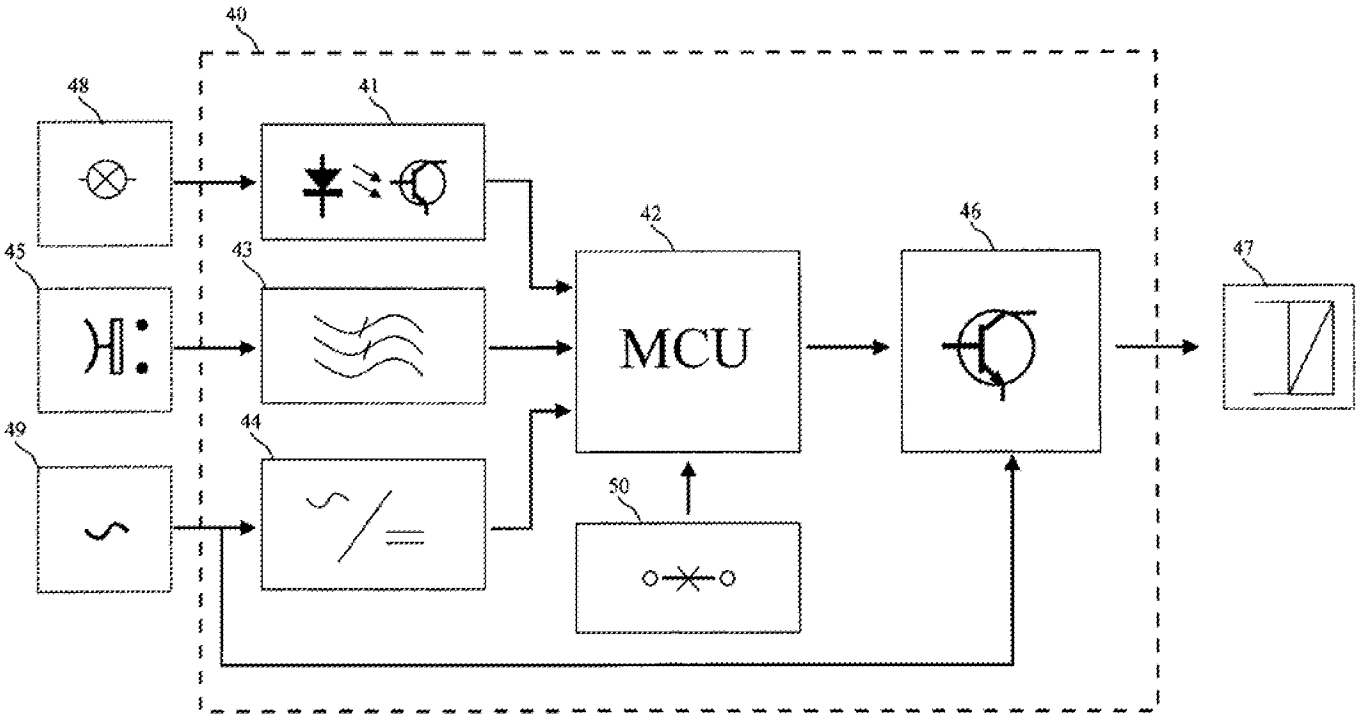
FIG. 4 schematically illustrates the preferred embodiment of an electronic control system capable to ensure the synchronization of the disengagement of the lock with the operation of the gate according to the abovementioned control method.

FIG. 4 schematically illustrates a preferred embodiment for the electronic system capable to operate according to the control logic described in FIG. 3.

The electronic system is presented in the frame (40) and comprises:

one logic unit (42) capable to embody a logic state machine;

one power supply system (44) that can supply the current required to power the electronic system drawing energy from a power source (49) that is possibly part of the gate automation system;

one signal interface (41) that can check status of activation of the machinery-in-motion warning flasher, and, considering that flasher signal is usually a 110-230 Vac signal, the interface would possibly comprise a photocoupler or relay unit;

possibly, one signal interface (43) that can collect an electrical unlock control signal from a switch (45) providing the required level of rejection of the interferences;

one power control (46) controlled by the logic unit (42) that can energize the electric coil (47) of the solenoid (10) when required;

possibly, the possibility of configuring the type of control logic and the related timings by acting on switches or jumpers (50).

What is claimed is:

1. A lock device for ensuring a proper unlock sequence for an automated sliding gate, comprising:

a keeper including an opening that does not have circular symmetry, the keeper also including an obstacle aligned with the opening and providing a bottoming point for a latch member entering the opening;

a frame having both structural and protection encasing functionalities;

a latch member projecting out from the frame and having a projection axis, the latch member being rotatable and translatable with respect to the frame respectively around and along the projection axis, the latch member being aligned with a direction of sliding motion of the sliding gate and with the opening of the keeper, the latch member having a lateral protruding tooth that can be axially and non-rotationally displaced across the opening when the lateral protruding tooth is rotationally aligned with a corresponding receiving portion of the opening;

a coupling system between the frame and the latch member that links a specific translation of the latch member with a specific rotation of the latch member;

a lock system that automatically engages upon a given axial displacement of the latch member into the frame, causing a one-way transition of the lock device from a stable unlocked state to a stable locked state, the stable unlocked state including a position of the latch member which the lateral protruding tooth can be axially and non-rotationally displaced across the opening, the stable locked state excluding a position of the latch member at which the lateral protruding tooth can be axially displaced across the opening, and the engagement of the lock system preventing any reverse transition from the stable locked state to the stable unlocked state by acting only on the latch member;

a manual unlock control for independently driving disengagement of the lock system to allow reverse transition from the stable locked state to the stable unlocked state;

an electrically controlled actuator for independently driving the disengagement of the lock system to allow the reverse transition from the stable locked state to the stable unlocked state;

a control system for causing the disengagement of the lock system that uses an electrical control signal to cause a transition from the stable locked state to a metastable unlocked state that is maintained until the latch member reaches a position of the stable unlocked state, the transition from the metastable unlocked state to the stable unlocked state triggered by a direct or indirect feedback of at least one chosen from the position of the latch member and an expiration of a temporized delay.

2. The device of claim 1, wherein the coupling system includes a desmodromic cam and tappet mechanism.

3. The device of claim 2, wherein the lock system comprises a spring-loaded moveable member that aligns with and engages a cavity on a lateral surface of the latch member, when the latch member reaches a specific section of an allowed translation while being in the stable unlocked state, a shape of the cavity limiting a range of further translation of the latch member to positions solely within the stable locked state, the range of further translation allowing for settlements and thermal distortions of the gate that could load and jam the lock device.

4. The device of claim 3, wherein the disengagement of the lock system can be driven by an electrical current flowing in the coil of a solenoid which comprises or drives the moveable member, and the disengagement of the lock system is also independently drivable by operating a cylinder lock that acts on the moveable member directly or through a transmission leverage.

5. The device of claim 4, wherein the metastable unlocked state is maintained through at least one chosen from an energization of the electrically controlled actuator performed according to a control logic that ceases the energization when a certain delay has elapsed and feedback is generated indicating that the latch member has reached the stable unlocked state, and at which the engagement of the lock system is rearmed but out of the given axial displacement, the control logic being software-implemented in at least one chosen from a gate automation system and an electronic unit that interfaces the lock device with the gate automation system.

6. The device of claim 4, wherein the metastable unlocked state is maintained through a mechanism that is armed when the system reaches the stable locked state and is triggered when the electrically controlled actuator is energized, in the triggered state, the mechanism prevent reengagement of the lock system, the mechanism being released from the triggered state when the latch member reaches a position of the stable unlocked state and at which engagement of the lock system is rearmed but out of the given axial displacement.

7. The device of claim 6, and further comprising a mechanical unlock control for independently driving the disengagement of the lock system to allow reverse transition from the stable locked state to the stable unlocked state, the mechanical unlock control including a remotely operable Bowden cable drive system.

8. The device of claim 6, and further comprising a ring shaped element located on a portion of the latch member that can remain accessible in the stable locked state, the ring-shaped element being able to rotate freely on the latch member to prevent sawing of the latch member.

9. The device of claim 6, and further comprising a lock enclosure having a cover and an interlocking mechanism preventing removal of the cover from the lock enclosure, the interlocking mechanism comprising a hook coupling between the latch member and the cover that engages only when the latch member is in the stable locked state.

10. The device of claim 6, wherein the keeper is shaped so that a tool access path to at least one hole of the keeper for receiving a fastening element is blocked when the latch member is engaged in the keeper in the stable locked state.

11. The device of claim 1, wherein the metastable unlocked state is maintained through at least one chosen from an energization of the electrically controlled actuator performed according to a control logic that ceases the energization when a certain delay has elapsed and a feedback is generated indicating that the latch member has reached the stable unlocked state, and at which the engagement of the lock system is rearmed but out of the given axial displacement, the control logic being software-implemented in at least one chosen from a gate automation system and an electronic unit that interfaces the lock device with the gate automation system.

12. The device of claim 1, wherein the metastable unlocked state is maintained through a mechanism that is armed when the system reaches the stable locked state and is triggered when the electrically controlled actuator is energized, in the triggered state, the mechanism prevent reengagement of the lock system, the mechanism being released from the triggered state when the latch member reaches a position of the stable unlocked state and at which engagement of the lock system is rearmed but out of the given axial displacement.

13. The device of claim 1, and further comprising a mechanical unlock control for independently driving the disengagement of the lock system to allow reverse transition from the stable locked state to the stable unlocked state, the mechanical unlock control including a remotely operable Bowden cable drive system.

14. The device of claim 1, and further comprising a ring shaped element located on a portion of the latch member that can remain accessible in the stable locked state, the ring-shaped element being able to rotate freely on the latch member to prevent sawing of the latch member.

15. The device of claim 1, and further comprising a lock enclosure having a cover and an interlocking mechanism preventing removal of the cover from the lock enclosure, the interlocking mechanism comprising a hook coupling between the latch member and the cover that engages only when the latch member is in the stable locked state.

16. The device of claim 1, wherein the keeper is shaped so that a tool access path to at least one hole of the keeper for receiving a fastening element is blocked when the latch member is engaged in the keeper in the stable locked state.

17. The device of claim 3, wherein the metastable unlocked state is maintained through at least one chosen from an energization of the electrically controlled actuator performed according to a control logic that ceases the energization when a certain delay has elapsed and a feedback is generated indicating that the latch member has reached the stable unlocked state, and at which the engagement of the lock system is rearmed but out of the given axial displacement, the control logic being software-implemented in at least one chosen from a gate automation system and an electronic unit that interfaces the lock device with the gate automation system.

18. The device of claim 3, wherein the metastable unlocked state is maintained through a mechanism that is armed when the system reaches the stable locked state and is triggered when the electrically controlled actuator is energized, in the triggered state, the mechanism prevent reengagement of the lock system, the mechanism being released from the triggered state when the latch member reaches a position of the stable unlocked state and at which engagement of the lock system is rearmed but out of the given axial displacement.

19. The device of claim 3, and further comprising a mechanical unlock control for independently driving the disengagement of the lock system to allow reverse transition from the stable locked state to the stable unlocked state, the mechanical unlock control including a remotely operable Bowden cable drive system.

20. The device of claim 3, and further comprising a lock enclosure having a cover and an interlocking mechanism preventing removal of the cover from the lock enclosure, the interlocking mechanism comprising a hook coupling between the latch member and the cover that engages only when the latch member is in the stable locked state.

* * * * *